US011764495B2

(12) United States Patent
Schlegel et al.

(10) Patent No.: US 11,764,495 B2
(45) Date of Patent: Sep. 19, 2023

(54) PROTECTIVE CONDUCTOR CONNECTION

(71) Applicant: HARTING Electric Stiftung & Co. KG, Espelkamp (DE)

(72) Inventors: Bernard Schlegel, Rahden (DE); Florian Hackemeier, Rahden (DE); Mario Stolle, Goldenstedt (DE)

(73) Assignee: HARTING Electric Stiftung & Co. KG, Espelkamp (DE)

( * ) Notice: Subject to any disclaimer, the term of this patent is extended or adjusted under 35 U.S.C. 154(b) by 210 days.

(21) Appl. No.: 17/423,499

(22) PCT Filed: Feb. 11, 2020

(86) PCT No.: PCT/DE2020/100088
§ 371 (c)(1),
(2) Date: Jul. 16, 2021

(87) PCT Pub. No.: WO2020/164664
PCT Pub. Date: Aug. 20, 2020

(65) Prior Publication Data

US 2022/0094081 A1 Mar. 24, 2022

(30) Foreign Application Priority Data

Feb. 13, 2019 (DE) ..... 10 2019 103 561.9
Feb. 14, 2019 (DE) ..... 10 2019 103 772.7

(51) Int. Cl.
*H01R 4/48* (2006.01)
*H01R 9/24* (2006.01)

(52) U.S. Cl.
CPC ..... *H01R 4/4836* (2013.01); *H01R 4/4845* (2013.01); *H01R 9/2491* (2013.01)

(58) Field of Classification Search
None
See application file for complete search history.

(56) References Cited

U.S. PATENT DOCUMENTS 5,478,259 A 12/1995 Noschese
6,004,163 A 12/1999 Behling et al.
(Continued)

FOREIGN PATENT DOCUMENTS

CN 102474046 A 5/2012
DE 8111418 U1 11/1981
(Continued)

OTHER PUBLICATIONS

HARTING Technology Group, HARTING Selection Guide Han-Modular® Connectors, Apr. 11, 2017.

*Primary Examiner* — Ross N Gushi
(74) *Attorney, Agent, or Firm* — Smartpat PLC

(57) ABSTRACT

A protective conductor connection connects a protective conductor to a busbar of a grounding element. The grounding element extends in a plug-in direction on a wall of an isolating body of the plug connector. The grounding element has a mounting region for mounting on the wall, a contact element for electrically contacting a counterpart plug connector, and a contact surface for electrical contacting a plug connector housing. A spring element and an actuating element are provided on the mounting region and configured such that the actuating element, during actuation thereof, interacts with the spring element such that, in a first position of the actuating element, a contact connection for the protective conductor to the current rail is opened by the spring element, and in a second position of the actuating element, a contact connection for the protective conductor to the current rail is closed by the spring element.

11 Claims, 5 Drawing Sheets

(56) References Cited

U.S. PATENT DOCUMENTS

| | | | | |
|---|---|---|---|---|
| 6,336,824 | B1 * | 1/2002 | Sorig | H01R 4/4836 439/441 |
| 7,004,781 | B2 | 2/2006 | Walter | |
| 7,597,562 | B2 | 10/2009 | Genesius et al. | |
| 9,899,752 | B2 * | 2/2018 | Wu | H01R 4/4827 |
| 2004/0102078 | A1 | 5/2004 | Miyoshi et al. | |
| 2007/0099479 | A1 | 5/2007 | Holterhoff et al. | |
| 2010/0087083 | A1 | 4/2010 | Skowranek | |
| 2012/0108099 | A1 | 5/2012 | Hanning et al. | |
| 2012/0135621 | A1 | 5/2012 | Hayauchi | |
| 2012/0315790 | A1 | 12/2012 | Hein et al. | |
| 2014/0127932 | A1 | 5/2014 | Hoppmann et al. | |
| 2014/0179172 | A1 | 6/2014 | Riepe et al. | |
| 2015/0222058 | A1 | 8/2015 | Bertsch | |
| 2016/0248174 | A1 | 8/2016 | Ludewig et al. | |
| 2016/0314911 | A1 | 10/2016 | Knoerrchen et al. | |
| 2016/0336677 | A1 | 11/2016 | Herbrechtsmeier | |

FOREIGN PATENT DOCUMENTS

| | | | |
|---|---|---|---|
| DE | 29505272 | U1 | 7/1995 |
| DE | 29520008 | U1 | 3/1996 |
| DE | 102004001202 | A1 | 7/2004 |
| DE | 10325009 | B4 | 9/2004 |
| DE | 202005015465 | U1 | 2/2007 |
| DE | 202006009460 | U1 | 3/2007 |
| DE | 60128235 | | 12/2007 |
| DE | 102007013536 | | 10/2008 |
| DE | 202010008028 | U1 | 12/2010 |
| DE | 102010017717 | A1 | 1/2012 |
| DE | 102011115637 | A1 | 12/2012 |
| DE | 102012016725 | A1 | 2/2014 |
| DE | 102013108383 | A1 | 2/2015 |
| DE | 102013111574 | A1 | 4/2015 |
| DE | 202014010621 | U1 | 2/2016 |
| DE | 202016008409 | U1 | 11/2017 |
| DE | 202017107035 | U1 | 12/2017 |
| DE | 102016120002 | A1 | 4/2018 |
| DE | 202017101365 | U1 | 6/2018 |
| EP | 1309036 | A1 | 5/2003 |
| EP | 2544314 | B1 | 11/2014 |
| EP | 3128616 | A1 | 2/2017 |
| EP | 3312940 | A1 | 4/2018 |
| FR | 2936659 | A1 | 4/2010 |
| JP | 2004319196 | A | 11/2004 |
| WO | 9733347 | A1 | 9/1997 |
| WO | 2011017282 | A1 | 2/2011 |
| WO | 2011069522 | A1 | 6/2011 |
| WO | 2015091098 | A1 | 6/2015 |

* cited by examiner

PROTECTIVE CONDUCTOR CONNECTION

CROSS-REFERENCE TO RELATED APPLICATION

This application is a national stage application, filed under 35 U.S.C. § 371, of International Patent Application No. PCT/DE2020/100088, filed on 2020 Feb. 11, which claims the benefit of German Patent Applications No. 10 2019 103 561.9, filed 2019 Feb. 13 and No. 10 2019 103 772.7, filed 2019 Feb. 14.

TECHNICAL FIELD

The disclosure relates to a protective conductor connection for a grounding element of a plug connector and a housing which is suitable for such a protective conductor connection.

In the event of a short-circuit of a live conductor to a conductive, touchable part, e.g. a housing, grounding elements of plug connectors which are connected to protective conductors serve to maintain this touchable part at ground potential and to trip a fuse and thereby prevent or at least reduce a current flow to ground, in particular through the (human) body.

An added requirement of plug connectors is that an electrical connection between the grounding elements must preferably be created when mating the plug connector with its mating connector.

BACKGROUND

In solutions known from the prior art, a screw connection is provided as a protective conductor connection on the grounding element, whereby the protective conductor is fastened on the grounding element with the aid of a screwdriver. In this case, to connect a protective conductor, a screw has to be screwed into the grounding element or unscrewed. Vibrations can cause this screw to come loose over time, which results in the protective conductor losing its function.

In this case, there are moreover numerous opportunities for a screw connection of the protective conductor to be connected incorrectly since attention needs to be paid to the tightening torque of the screw. With too low a tightening torque, the connection between the grounding element and the protective conductor can come loose and interrupt the electrical connection. With too high a tightening torque, the protective conductor can become damaged, which results in the risk of the protective conductor breaking. Moreover, the protective conductor can also be fastened on the wrong side of the screw such that it is pressed outwards in an undesired manner.

Furthermore, as is the case when fastening a protective conductor connected to the grounding element, this protective conductor can also only be released by means of a screwdriver, which, if necessary, is disadvantageously time-consuming.

By way of example, DE 10 2012 016 725 A1 discloses a protective conductor connection, provided by means of a screw connection, for a grounding element of a plug connector, which has the disadvantages described above.

The protective conductor connection moreover has a protective conductor contact, which forms a contact pin and has a connection block on the contact pin. A housing wall of the plug connector housing forms a bearing which adjoins a cylindrical wall portion of the connection block such that the receiving region or the connection region for receiving a protective conductor into which the screw of the screw connection can be screwed in order to clamp the protective conductor to be connected against the housing wall is located between the housing wall and the cylindrical wall portion.

In the case of the protective conductor connection which is formed as above and mounted on the plug connector housing, the protective conductor must be connected to the grounding element already arranged on the plug connector housing. Mounting a grounding element which is already equipped with a connected protective conductor is not possible. The disadvantages described above are therefore promoted.

The German Patent and Trademark Office has searched the following prior art in the priority application relating to the present application: DE 10 2012 016 725 A1, DE 10 2016 120 002 A1, DE 20 2017 107 035 U1, DE 601 28 235 T2.

SUMMARY

An object of the disclosure is to provide a fail-safe and easy-to-handle protective conductor connection for a grounding element of a plug connector. In this case, a further object of the disclosure is to provide a suitable housing for an above protective conductor connection.

The object is achieved by the features of the independent claims.

Advantageous configurations are indicated in the subclaims and/or in the description below.

The present disclosure relates in particular to a protective conductor connection for connecting a protective conductor to a busbar of a grounding element which extends in the mating direction of a plug connector and is provided on a wall of an insulating body of the plug connector.

The grounding element has a mounting region for mounting the grounding element on the wall of the insulating body and a contact element for providing an electrical contact with a mating plug connector and a contact surface for providing an electrical contact with a plug connector housing.

The contact element can be suitably formed as a contact pin, which extends on a wall of a connection region of the insulating body in the mating direction for connection to a mating plug connector.

A spring element and an actuating element, formed and arranged to correspond to the spring element, are provided on the mounting region of the grounding element. In this case, the actuating element and the spring element are formed and arranged in such a way that the actuating element, upon its actuation, cooperates with the spring element in such a way that a contact connection of the protective conductor to the busbar is actuated by means of the spring element.

In this case, the contact connection is opened in a first position of the actuating element in the mating direction and closed in a second position of the actuating element in the mating direction.

For this purpose, the actuating element can be particularly advantageously formed and arranged to be displaceable in the mating direction in such a way that it can be brought from the first position, in which the contact connection is opened, into the second position, in which the contact connection is closed, by means of a first actuation of the actuating element acting in the mating direction.

In this case, the actuating element is moreover suitably formed and arranged in such a way that the actuating element can moreover be brought from the second position into the first position by means of a second actuation of the actuating element acting contrary to the mating direction.

As a result of the advantageous provision of the actuating element, the contact connection for the protective conductor can be both opened and closed particularly easily and reliably, in particular from the cable connection direction, whereby the protective conductor can be easily and securely connected to the protective conductor contact without a time-consuming and awkward operation.

In this case, it is also particularly advantageous that the first and second position are enabled by means of a simple and oppositely directed linear displacement of the actuating element in the mating direction and/or contrary to the mating direction, for which a time-consuming and complicated operation is not required. Possible operating errors and malfunctions caused thereby can therefore be advantageously substantially eliminated.

The mounting region of the grounding element can suitably have an angled first and second limb formed opposite one another, wherein the busbar can be easily provided by means of the first limb, i.e. formed by the first limb. The busbar is thus advantageously formed in one piece with the grounding element.

In this case, the spring element and the actuating element can be adjacently arranged between the first and second limb in such a way that a contour of the actuating element cooperates with an adjacent contour of the spring element. A suitable frame for positioning the spring element and the actuating element can thus be provided by means of the first and second limb. In this case, the first limb, by means of which the busbar is also provided, has a particularly advantageous dual function.

The spring element can suitably be a cage clamp having a window aperture, a planar contact surface and a tensioning limb. Such cage clamps are particularly reliable and are available with a desirable spring constant for providing a reliable electrical and moreover also mechanical contact. The spring properties of the spring element advantageously formed as a cage clamp particularly advantageously enable contacting between protective conductors having different conductor cross-sections and the busbar after the contact pressure between the protective conductors and the busbar by means of the spring element increases desirably with the increasing conductor cross-section of the protective conductors.

The spring element is arranged in a space-saving manner in such a way that it abuts extensively with its planar contact surface against a first contact surface of the first limb, which is opposite the second limb. In this case, the window aperture embraces a freely projecting lug, which is slightly angled and adjoins the contact surface of the spring element, and moreover an upper lug, which is formed on the first limb and is likewise angled.

The spring element is thus arranged in a space-saving and secure manner on the first limb in such a way that, in the first position, the window aperture extends beyond a second contact surface of the first limb, which is opposite the first contact surface of the first limb, and is exposed for receiving a protective conductor. In this case, the window aperture of the spring element is suitably formed in such a way that the protective conductor connection, making use of the above-described positive influences of the spring properties of a cage clamp, is advantageously suitable for connecting protective conductors having a conductor cross-section of 0.15 $mm^2$ to 4 $mm^2$.

In the first position, the spring element is in an advantageously pre-tensioned state provided by means of the actuating element, which cooperates with the spring element and is arranged adjacent to the spring element, and the second limb. A corresponding advantageous contour and arrangement of the actuating element is also described below with reference to the above-mentioned second limb, by means of which an opposite limb to the first limb is provided.

In the second position, a protective conductor inserted into the window aperture is clamped against the second contact surface of the first limb and its upper advantageously angled lug by the spring element, which is in a relaxing state compared to the first position. In this case, protective conductors without a cable end sleeve are pressed into the kink in the angled lug and are therefore protected against being inadvertently pulled out. The corresponding advantageous contour and arrangement of the actuating element is likewise also described below with reference to the above-mentioned second limb. The advantageously angled upper lug of the first limb moreover effectively prevents the spring element from sliding out of its predetermined operating position.

The actuating element can be suitably formed like a bolt, which extends between the first and second limb in the mating direction and abuts with a first side against a contact surface of the second limb, which is opposite the first contact surface of the first limb.

In this case, a second side of the actuating element, which faces the spring element, has a contour which cooperates with the spring element described above and has a tensioning shoulder, a tensioning chamfer and an actuating aperture, wherein the thickness of the actuating element at its actuating aperture is considerably reduced compared to the thickness at its tensioning shoulder.

The spring element and the actuating element are thus advantageously formed and arranged in such a way that the tensioning shoulder, in the first position of the actuating element, is arranged to correspond to the tensioning limb of the spring element and cooperates accordingly. In this case, the spring element is tensioned by a tensioning force provided by means of the actuating element and the second limb in such a way that the window aperture of the spring element extends beyond the second contact surface of the first limb and is exposed for receiving a protective conductor. The first and second limb have sufficient material strength for this purpose.

In the second position, the actuating aperture of the actuating element cooperates with the tensioning limb of the spring element in such a way that the spring element is comparatively expanded in the direction of the actuating element, wherein the tensioning limb of the spring element is arranged in the actuating aperture of the actuating element. The spring element is therefore comparatively relaxed in the second position, wherein the window aperture of the spring element is pulled with its end in the direction towards the first limb and its upper lug and the spring element clamps a protective conductor previously inserted into the window aperture in the first position against the second contact surface and the upper lug of the first limb by means of a spring force as described above.

In the case of an above-described simple actuation of the actuating element by means of a first and/or second actuation of the actuating element acting in the mating direction and/or contrary to the mating direction, the tensioning limb of the spring element advantageously cooperates with the tensioning chamfer of the actuating element in such a way that the actuating element is brought from the first and/or second position into the second and/or first position in each case, whereby the spring element is tensioned and/or relaxed accordingly by means of the actuating element and the second tensioning limb.

The side of the actuating element which is opposite the above-described contour cooperating with the spring element and which abuts against the contact surface of the second limb has an engagement chamfer having an adjoining engagement step, which are easily accessible for a tool via a tool insertion opening formed in a head of the actuating element.

By means of a lever action of a tool which is inserted into the tool insertion opening, in particular from the cable connection direction, and applied to an edge between the engagement chamfer and the engagement step via an edge of the second limb acting as a pivot point, a predetermined force can be easily exerted on the actuating element contrary to the mating direction. In this case, the actuating element is actuated contrary to the mating direction and brought from the above-described second position, in which the tensioning limb of the spring element is arranged in the actuating aperture, via the tensioning chamfer into the first position, in which the tensioning limb is arranged on the tensioning shoulder and in which the spring element is tensioned accordingly, as described above.

An above-described first actuation of the actuating element acting in the mating direction and in which the actuating element is brought from the first position into the second position, in which the spring element is comparatively relaxed, can also be easily provided without a tool by exerting a slight manual pressure on the head of the actuating element in the mating direction.

In this case, the above exertion of pressure is substantially needed for a displacement of the actuating element from the first position to a position in which the tensioning limb of the spring element is arranged on the tensioning chamfer, whereby a further displacement of the actuating element to the second position is achieved by means of a comparatively slight pressure.

The above-mentioned contact surface of the grounding element for providing an electrical contact with the plug connector housing can be suitably provided by means of a third and fourth limb, which are symmetrically formed on the mounting region of the grounding element, angled perpendicularly towards the mating direction, and are provided as a flange for mounting on a protrusion formed on the wall of the insulating body. Suitable means for fastening the grounding element on the insulating body and/or the plug connector housing can be provided on the contact surface, which means can be provided by means of screws.

A desirable stop for a displacement of the actuating element in the mating direction of the plug connector can be suitably provided by means of one of the limbs of the contact surface, whereby this limb has an advantageous dual function. In this case, such a stop provides additional effective protection against incorrect operation of the actuating element of the protective conductor contact.

To provide a housing for an above-described inventive protective conductor contact, a housing half shell formed and cooperating in an interlocking manner with the mounting region of the grounding element can be provided, wherein the mounting region and the housing half shell can be assembled to form a housing in which the spring element and the actuating element are advantageously accommodated. The spring element and the contact connection for the protective conductor, which is provided by means of the spring element and the first limb, are effectively protected as a result of providing the housing.

The above housing half shell can have an advantageous inner contour which, in addition to the mounting region, moreover cooperates in an interlocking manner with the first and second limb and the actuating element. In this case, a first projection with a protective conductor entry for the protective conductor can be formed on a wall of the housing half shell.

The first projection can have a peg, which suitably cooperates in an interlocking manner with an aperture formed in the mounting region of the grounding element in such a way that the peg latches with the mounting region of the grounding element during the assembly of the housing half shells.

A first and second bearing surface can furthermore be formed on the first projection for bearing against the mounting region, and a third and fourth bearing surface can furthermore be formed on the first projection for bearing against the first limb, whereby an assembled housing has a desirable stability. The first and second bearing surface are suitably formed parallel to the mating direction. In this case, the third bearing surface is advantageously formed parallel to the mating direction and the fourth bearing surface is formed perpendicularly to the mating direction and corresponds to a lower edge of the first limb. A desirable stability of the housing is promoted as a result of this measure.

In this case, the first projection suitably has an aperture for receiving the spring element protruding beyond the second contact surface of the first limb in the first position, wherein the aperture also extends in particular through the third bearing surface.

To further increase the stability of the housing, a fifth bearing surface for bearing against the actuating element can moreover be formed on the first projection and a chamfer can moreover be provided on the first projection, by means of which chamfer a stop for the actuating element is provided contrary to the mating direction. In this case, the chamfer formed on the first projection cooperates with the tensioning chamfer of the actuating element. As a result of this measure, the actuating element protruding with its head out of the housing for its actuation is effectively held in the housing and protected against escaping.

To further increase the stability of the housing, a second lateral projection having a first and second bearing surface for bearing against the second limb and having a third bearing surface for bearing against the actuating element and having a fourth bearing surface for bearing against the mounting region of the grounding element can moreover be formed on the wall of the housing half shell.

A guide for a displacement of the actuating element from the first position to the second position in the mating direction and from the second position to the first position contrary to the mating direction is provided by means of the third bearing surface of the second projection and the above-mentioned fifth bearing surface of the first projection.

This measure contributes to effective protection of the actuating element against incorrect operation.

A central block can moreover be suitably formed on the wall of the housing half shell, which block has a contour such that overbending protection is provided for the spring element.

For a desirably compact form of the housing, a wall of the housing can be provided by means of a central region of the mounting region of the grounding element and the wall of the housing half shell can be formed and arranged opposite this wall.

As a result of the above-described measures and features of a housing suitable for an inventive protective conductor contact, an advantageously stable and compact and easily mounted housing is enabled, which accommodates the spring element and the actuating element in a protective manner and from which the head of the actuating element protrudes contrary to the mating direction for its actuation.

The above invention accordingly moreover relates in particular to a housing for an above-described inventive protective conductor connection for connecting a protective conductor to a busbar of a grounding element extending in the mating direction of a plug connector and provided on a wall of an insulating body of the plug connector.

As described above, a wall of the housing is suitably provided by means of a mounting region of the grounding element, which is formed and provided for mounting on the wall of the insulating body.

In this case, the housing has a housing half shell described above and formed to correspond in an interlocking manner to the mounting region in such a way that the housing half shell can be assembled with the mounting region to form the housing.

As likewise described above, the mounting region of the inventive housing is advantageously formed to correspond to the housing half shell having an inner contour in such a way that the housing is suitable for accommodating a spring element provided on the mounting region and an actuating element cooperating with the spring element, wherein an inventive protective conductor connection is provided by means of the actuating element and the spring element in cooperation with the first and second limb described at the outset.

In particular, effective protection of the function of the protective conductor connection can be provided by means of the inventive housing for the inventive protective conductor connection. In this case, providing an inventive housing advantageously creates the opportunity to pre-mount a grounding element already equipped with a protective conductor and mount the grounding element, with the protective conductor contact protected in the housing and already equipped with a connected protective conductor, in its intended position on a wall of an insulating body of a plug connector.

The spring element formed as a cage clamp is suitably made from metal. The actuating element and the housing half shell can each be made from metal and/or a suitable plastic.

BRIEF DESCRIPTION OF THE DRAWINGS

An exemplary embodiment of the invention is illustrated in the drawings and will be explained in more detail below.

DETAILED DESCRIPTION

The figures contain partially simplified, schematic illustrations. Identical reference signs are sometimes used for elements which are similar but possibly not identical. Different views of similar elements may be drawn to different scales.

Figure 1A:
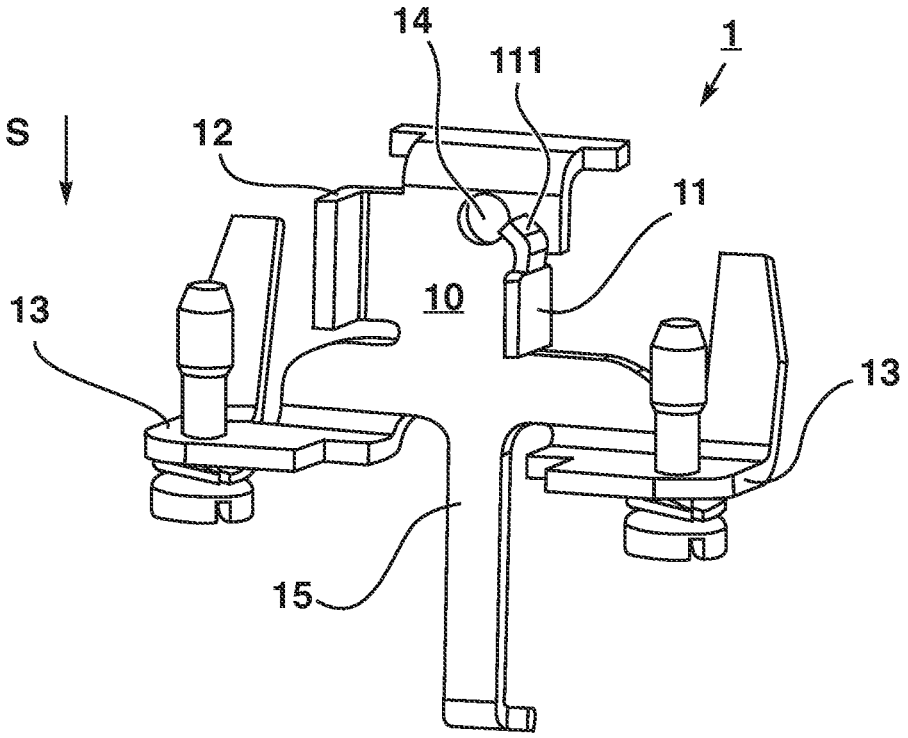
FIG. 1A shows a perspective illustration of a grounding element for a protective conductor connection according to an embodiment of the invention.
Figure 1B:
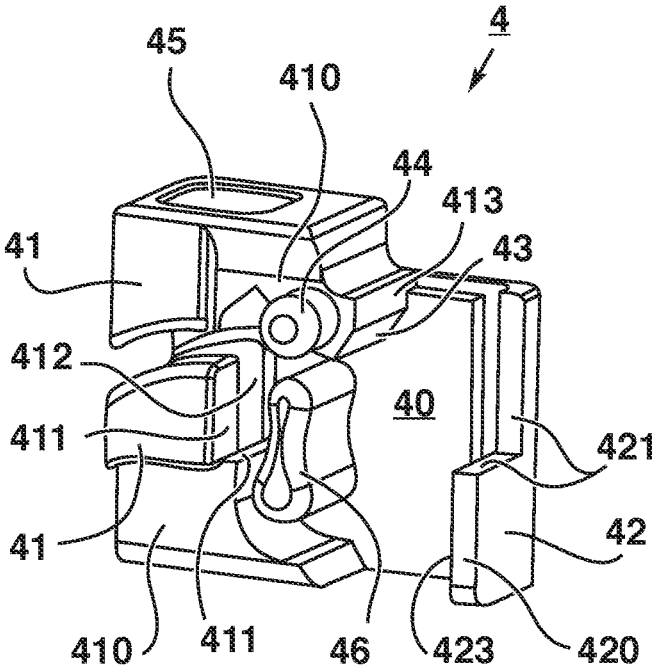
FIG. 1B shows a housing half shell for the grounding element.

FIG. 1A shows a perspective illustration of a grounding element 1 for a protective conductor connection according to an embodiment of the invention. FIG. 1B shows a housing half shell 4, which is suitably designed—rotated horizontally through 180° in the drawing—to be assembled with the grounding element 1 to form a common housing.

The grounding element 1 is suitably formed for connecting a protective conductor 5 of the invention and is provided for mounting on a wall 60 of an insulating body 6 of a plug connector. This insulating body 6 is described below with reference to FIG. 5. In this case, the grounding element 1 extends in the mating direction S of the plug connector.

The grounding element 1 has a mounting region 10 for mounting on the wall 60 and a contact element 15 for providing an electrical contact with a mating plug connector and a contact surface for providing an electrical contact with a plug connector housing. The contact element 15 of the embodiment of FIG. 1A is formed as a contact pin. A modified contact element 15 can be formed as a contact spring. The contact element has an angled portion at its end, which corresponds in an interlocking manner to a graduation formed on the insulating body 6.

The mounting region 10, like the contact element 15, likewise has such an angled portion, which corresponds in an interlocking manner to a graduation formed on the insulating body 6. A first 11 and second 12 limb, angled towards one another, are formed on the mounting region 10 of the grounding element 1. The first limb 11 is provided for providing a busbar for the contact connection for a protective conductor 5 and cooperates with a spring element 2. The second limb 12 provides an opposite limb to the first limb 11 and cooperates with an actuating element 3 presented below.

A third and fourth symmetrically formed limb 13 (shown in FIGS. 3A and 3B) are moreover angled perpendicularly to the mating direction S on the mounting region 10 of the grounding element 1. A contact surface for electrical contact with a plug connector housing and a flange for bearing and mounting on a protrusion 63 on a wall 60 of the insulating body 6 are provided by means of the third and fourth limb 13. Suitable screws are provided for this on the third and fourth limb 13.

An aperture 14 is furthermore provided in the mounting region 10, which aperture corresponds to a peg 44 formed on the housing half shell 4 of FIG. 1B. The peg 44 is provided on an inner contour of the housing half shell 4, which is formed on a wall 40 of the housing half shell 4.

A first projection 41, formed to be block-like and having a protective conductor entry 45 for inserting a protective conductor 5 into the assembled housing, is formed on the wall 40 of the housing half shell 4 shown in FIG. 1B.

The first projection 41 has the peg 44 formed to interlock with the aperture 14 formed in the mounting region 10. The first projection 41 formed to be block-like moreover has a first and second bearing surface 410 for bearing against the mounting region 10, and a third and fourth bearing surface 411 for bearing against the first limb 11. The third bearing surface 411 is formed parallel to the mating direction S and is provided for bearing against a second contact surface of the first limb 11. The fourth bearing surface 411 is formed perpendicularly to the mating direction S and provided for bearing against a lower edge of the first limb 11.

To receive a spring element 2, which is described below and protrudes beyond a second contact surface of the first limb 11 in a first position 1, an aperture 412 is formed in the first projection 41, which also extends in particular through the third bearing surface 411 of the first projection 41.

The first projection 41 moreover has a fifth bearing surface 413 for bearing against an actuating element 3 described below. A chamfer 43 is moreover formed on the first projection 41, which chamfer forms a common edge with the fifth bearing surface 413 and provides a stop for the actuating element 3 contrary to the mating direction S.

A second lateral projection 42 having a first and second bearing surface 421 for bearing against the second limb 12 and having a third bearing surface 423 for bearing against the actuating element 3 and having a fourth bearing surface 420 for bearing against the mounting region 10 is moreover formed on the wall 40 of the housing half shell 4. The first and second bearing surface 421 are provided in each case for bearing against an edge extending in the mating direction S and a lower edge of the second limb 12, which extends perpendicularly to the mating direction S.

A guide for a displacement of the actuating element 3 described below from the first position P1 to the second position P2 in the mating direction and from the second position P2 to the first position P1 contrary to the mating direction S is provided by means of the third bearing surface 423 of the second projection 42 and the above-described fifth bearing surface 413 of the first projection 41.

A central block 46 is moreover formed on the wall 40 of the housing half shell 4, which block has a contour such that overbending protection is provided for the spring element 2.

Figure 2A:
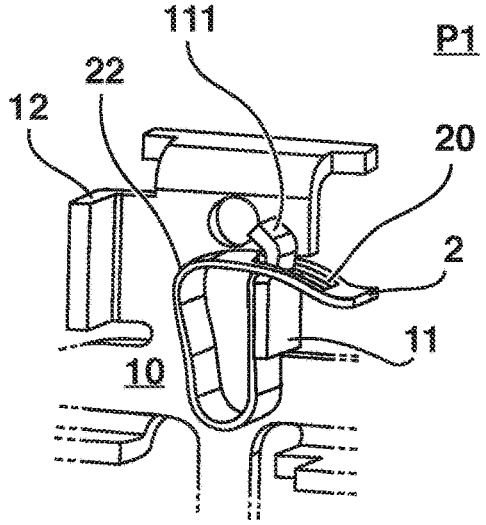
FIG. 2A shows a detail of the grounding element with a busbar and a spring element arranged thereon.

FIG. 2A shows a detail of the grounding element 1 of FIG. 1A with an above-mentioned spring element 2 in a pre-tensioned state, which corresponds to a first position P1 of an actuating element 3 described below with reference to FIGS. 2D and 2E and FIGS. 3A and 3B.

Figure 2B:
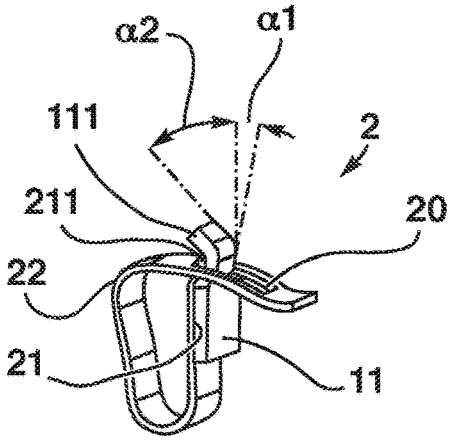
FIG. 2B shows the busbar with the spring element.
Figure 2C:
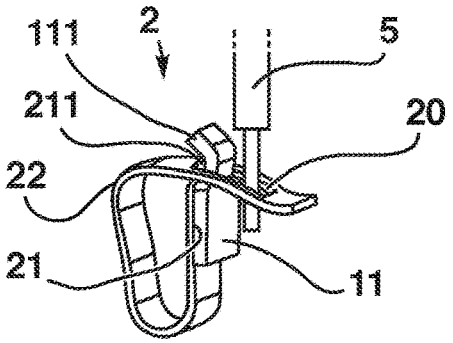
FIG. 2C shows the busbar with the spring element and a protective conductor.

FIG. 2B shows the spring element 2 arranged on the busbar 11 of the grounding element 1 of FIG. 2A, and FIG. 2C shows the spring element 2 of FIG. 2B with a protective conductor 5. The busbar is provided by means of the first limb 11.

The spring element 2 suitably formed as a cage clamp has a window aperture 20, a planar contact surface 21 and a tensioning limb 22, wherein the planar contact surface 21 abuts extensively against a first contact surface of the first limb 11, which is opposite the second limb 12.

The window aperture 20 embraces a freely projecting lug 211 of the spring element 2, which is slightly angled and adjoins the contact surface 21 of the spring element 2, and moreover an upper, angled lug 111 of the first limb 11. The lug 111 is firstly slightly angled towards the second contact surface of the first limb 11 at a first angle $\alpha 1$ and then angled towards the first contact surface of the first limb 11 at a second angle $\alpha 2$. A protective conductor 5 inserted into the window aperture 20 can thus be clamped against the second contact surface of the first limb 11 and against the upper lug 111, which is slightly angled at the first angle $\alpha 1$, by means of the window aperture 20 and can thereby also be mechanically held in a particularly secure and stable manner.

By means of the second angled portion at the angle $\alpha 2$ towards the first contact surface of the first limb 11, the spring element 2 is held in a stable manner on the first limb 11 with the lug thereof 211 located in the window aperture 20.

In the pre-tensioned state, which corresponds to the first position P1 of an actuating element 3, which is mentioned above and described below with reference to FIG. 3A, the window aperture 20 of the spring element 2 extends beyond the second contact surface of the first limb 11 and is exposed for receiving a protective conductor 5.

In a second position P2 of an actuating element 3, which is described below with reference to FIG. 3B, the spring element 2 clamps the protective conductor 5 inserted into the window aperture 20 from above according to FIG. 2C against the second contact surface of the first limb 11 and against the upper lug 111, which is slightly angled towards the second contact surface.

Figure 2D:
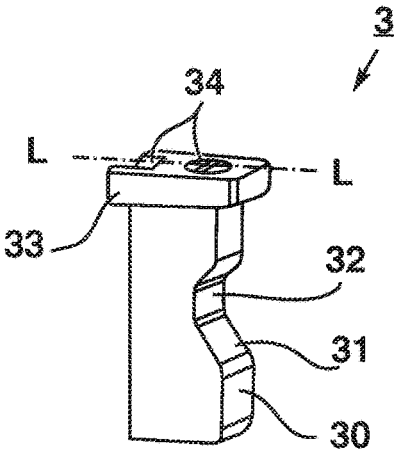
FIG. 2D shows an actuating element according to an embodiment of the invention.
Figure 2E:
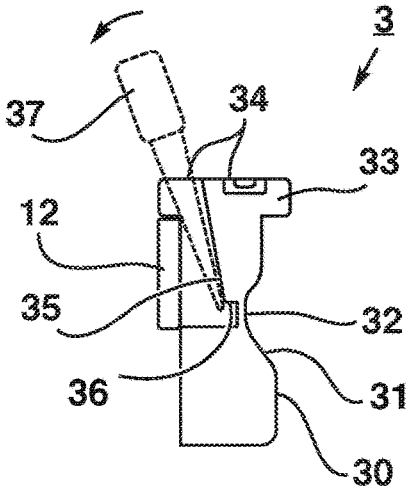
FIG. 2E shows a section through the actuating element along the line L-L of FIG. 2D together with a tool.

FIG. 2D shows an above-mentioned actuating element 3 according to an embodiment of the invention and FIG. 2E shows a section through the actuating element 3 of FIG. 2D along the line L-L of FIG. 2D together with a tool 37.

The actuating element 3 is formed to be bolt-like and extends between the first 11 and second 12 limb in the mating direction S and abuts with a first side against a contact surface of the second limb 12, which is opposite the first contact surface of the first limb 11. Please also refer to FIGS. 3A and 3B in this regard.

A second side of the actuating element, which faces the spring element 2, has a tensioning shoulder 30, a tensioning chamfer 31 and an actuating aperture 32.

The side of the actuating element 3 which abuts against the contact surface of the second limb 12 has an engagement chamfer 35 having an adjacent engagement step 36, which are accessible for a tool 37 via a tool insertion opening 34 formed in a head 33 of the actuating element 3.

By means of the tool 37 inserted into the tool insertion opening 34 and applied to the edge between the engagement chamfer 35 and the engagement step 36, a lever acting on the actuating element 3 contrary to the mating direction S can be provided by the upper edge of the second limb 12 acting as a pivot point. An actuation of the actuating tool acting contrary to the mating direction can thus be provided and the actuating element 3 can be easily brought from the second position P2 illustrated in FIG. 3B to its first position P1 of FIG. 3A. A further tool insertion opening 34 for a tool for an actuation of the actuating element 3 acting in the mating direction S is moreover provided in the head 33.

Figure 3A:
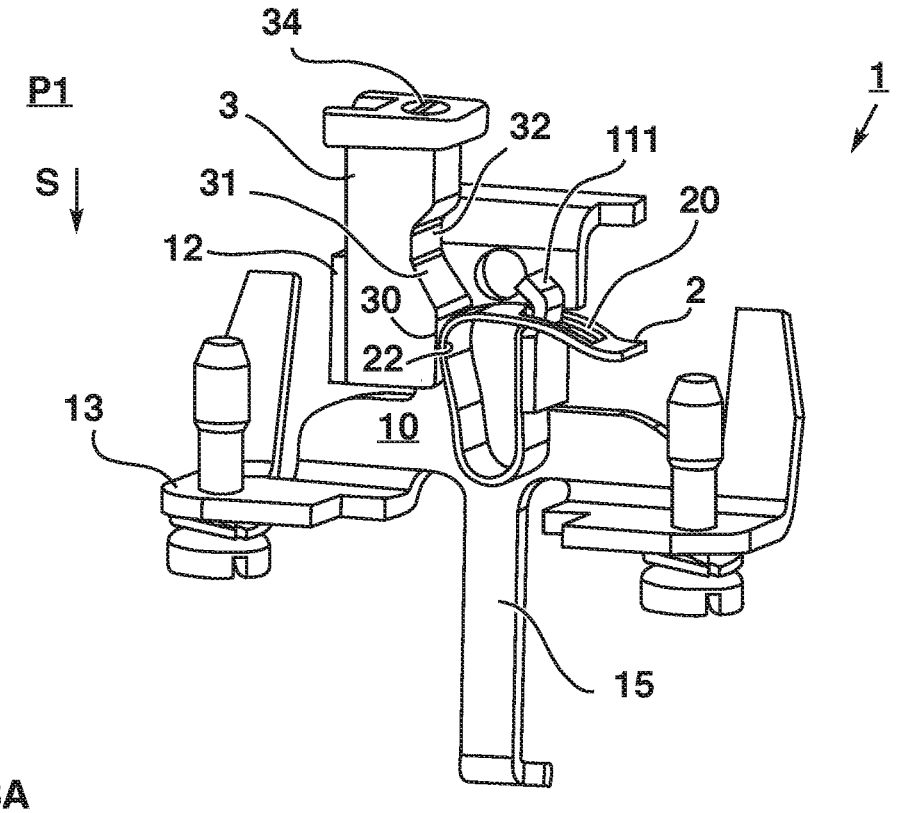
FIG. 3A shows a protective conductor connection according to an embodiment of the invention with the grounding element, the spring element and the actuating element in a first position.
Figure 3B:
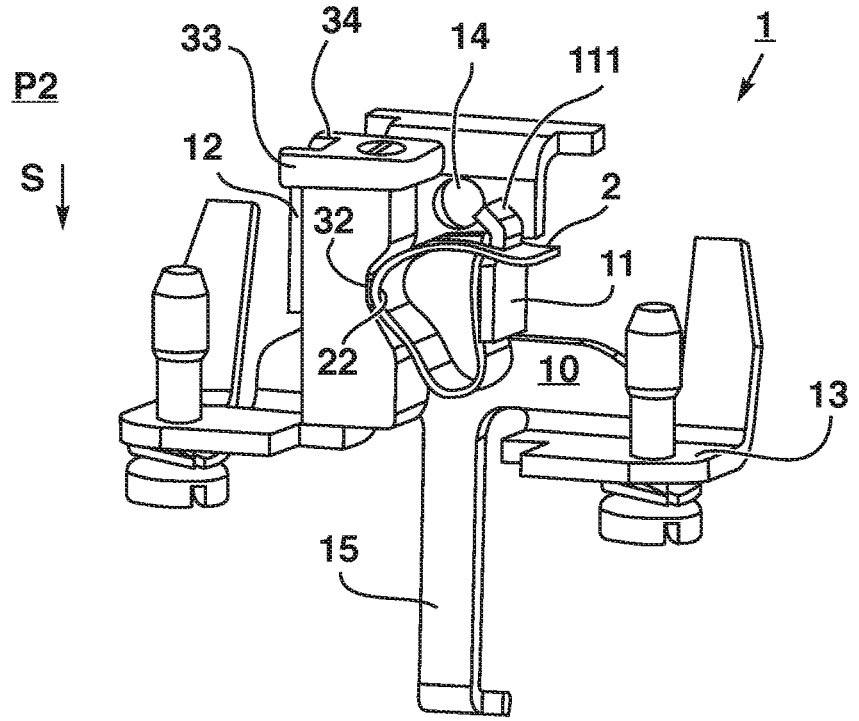
FIG. 3B shows the protective conductor connection with the actuating element in a second position.

In this regard, FIG. 3A shows a protective conductor connection according to an embodiment of the invention with the grounding element 1 of FIG. 1A, the spring element 2 of FIG. 2A and the actuating element 3 of FIG. 2D in the above-mentioned first position P1, and FIG. 3B shows the protective conductor connection of FIG. 3A in the above-mentioned second position P2.

The spring element 2 provided on the mounting region 10 of the grounding element 1 and the actuating element 3 are formed and arranged in such a way that the actuating element 3, upon its actuation, cooperates with the spring element 2 in such a way that a contact connection for a protective conductor 5 to a busbar is opened by means of the spring element 2 in the first position P1 of the actuating element 13 in the mating direction S of FIG. 3A. A contact connection for a protective conductor 5 to the busbar 11 is closed by means of the spring element 2 in the second position P2 of the actuating element 3 in the mating direction S of FIG. 3B. In this case, the busbar is provided by means of the first limb 11.

The actuating element 3 is formed and arranged to be displaceable in the mating direction S in such a way that the actuating element 3 can be displaced from the first position P1 to the second position P2 by means of a first actuation of the actuating element 3 acting in the mating direction S, and can be displaced from the second position P2 to the first position P1 by means of a second actuation of the actuating element 3 acting contrary to the mating direction S.

In the first position P1, the tensioning shoulder 30 of the actuating element 3 cooperates with the tensioning limb 22 of the spring element 2 in such a way that the spring element 2 is tensioned by a tensioning force provided by means of the actuating element 3 and the second limb 12 in such a way that the window aperture 20 extends beyond the second contact surface of the first limb 11 and is exposed for receiving a protective conductor 5. In this case, the tensioning limb 22 of the spring element 2 is arranged on the tensioning shoulder 30 of the actuating element 3.

In the second position P2, the actuating aperture 32 of the actuating element 3 cooperates with the tensioning limb 22 of the spring element 2 in such a way that, as described above, the spring element 2 clamps a protective conductor 5 inserted into the window aperture 20 against the second contact surface of the first limb 11 and the upper lug 111 by means of a spring force. For the sake of clarity, unlike FIG. 2C, a protective conductor 5 is not shown in FIG. 3B. In this case, the tensioning limb 22 of the spring element 2 is arranged in the actuating aperture 32 of the actuating element 3.

In the second position P2, the head 33 of the actuating element 3 abuts against the upper edge of the second limb 12. It remains to be mentioned that a thickness of the actuating element 3 in its region between the head 33 and the actuating aperture 32 is tapered compared to its thickness of the tensioning shoulder 30, wherein the chamfer 43 described above with reference to FIG. 1B cooperates with the tensioning chamfer 31 to provide a stop in the first position P1 upon the actuation of the actuating element 3 contrary to the mating direction S. As a result of this measure, it is ensured that the actuating element 3 does not escape from a housing provided by means of the housing half shell 4 and the mounting region 10 of the grounding element 1.

Upon an actuation of the actuating element 3 in the mating direction S, a stop for the actuating element 3 is provided in the second position P2 by means of a limb 13.

Upon an actuation of the actuating element 3, the tensioning limb 22 of the spring element 2 cooperates with the tensioning chamfer 31 of the actuating element 3 in such a way that the actuating element 3 is brought from the first P1 or second P2 position into the second P2 or first position P1 in each case. In this case, an actuation in the mating direction S can take place by means of a suitable tool and also manually, and an actuation contrary to the mating direction can take place by means of a tool 37 as described above.

Figure 4A:
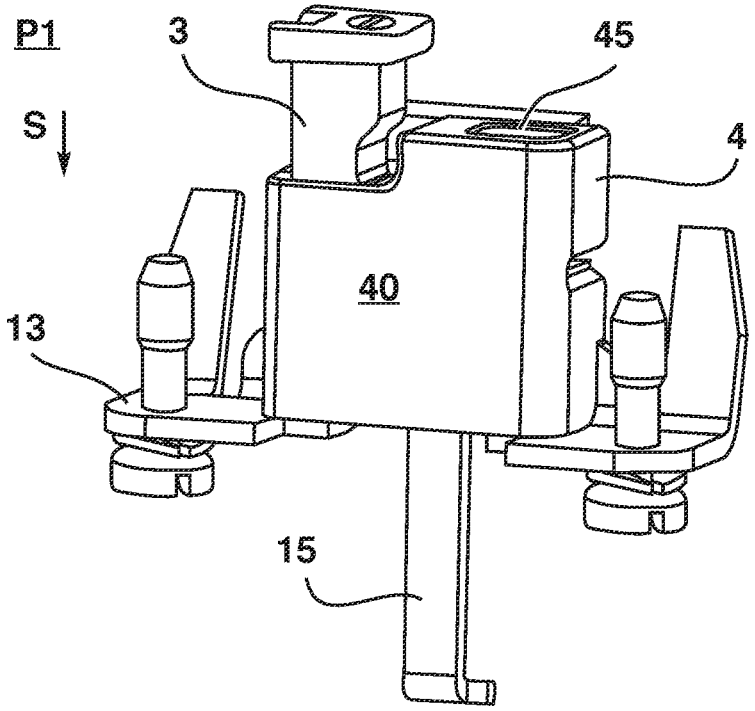
FIG. 4A shows the grounding element equipped with the housing half shell.

FIG. 4A shows the grounding element 1 of FIG. 3A, which is equipped with the housing half shell 4 of FIG. 1B, in the first position P1 with the actuating element 3 protruding with its head 33 out of the housing consisting of the housing half shell 4 and the grounding element 1. In this case, the wall 40 of the housing half shell 4 forms a wall of the assembled housing in which the spring element 2 and the actuating element 3 are accommodated.

Figure 4B:
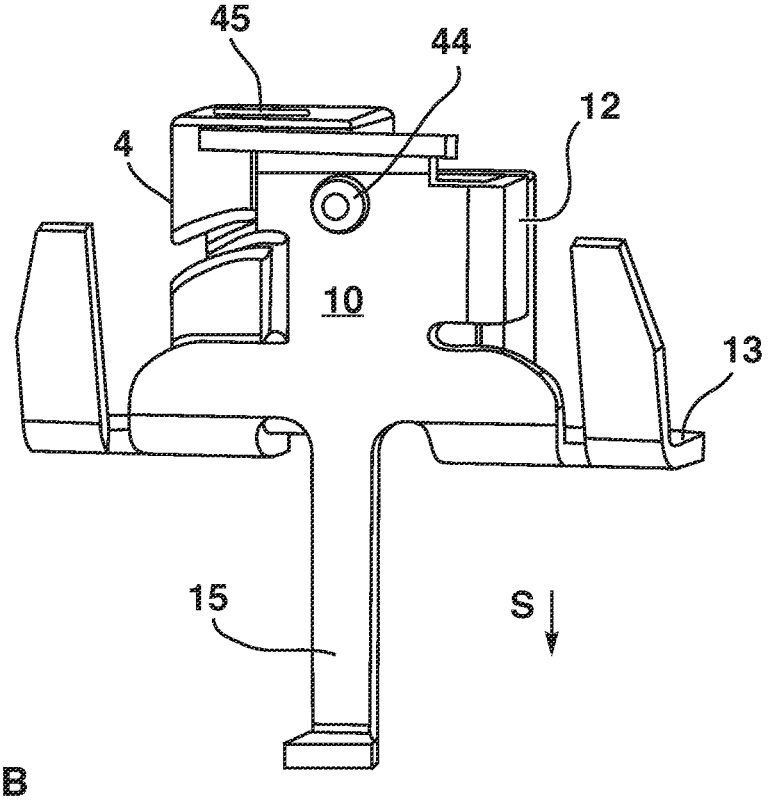
FIG. 4B shows the grounding element of FIG. 4A from the other side.

In this regard, FIG. 4B shows the assembled housing of FIG. 4A from the opposite direction with the wall of the housing provided by means of the mounting region 10 of the grounding element 1. In this case, the peg 44 of the housing half shell 4 is latched in an interlocking manner to the aperture 14 formed in the mounting region 10 of the grounding element 1. The screws for mounting the limbs 13 and the actuating element 3 are not shown in FIG. 4B.

Figure 5:
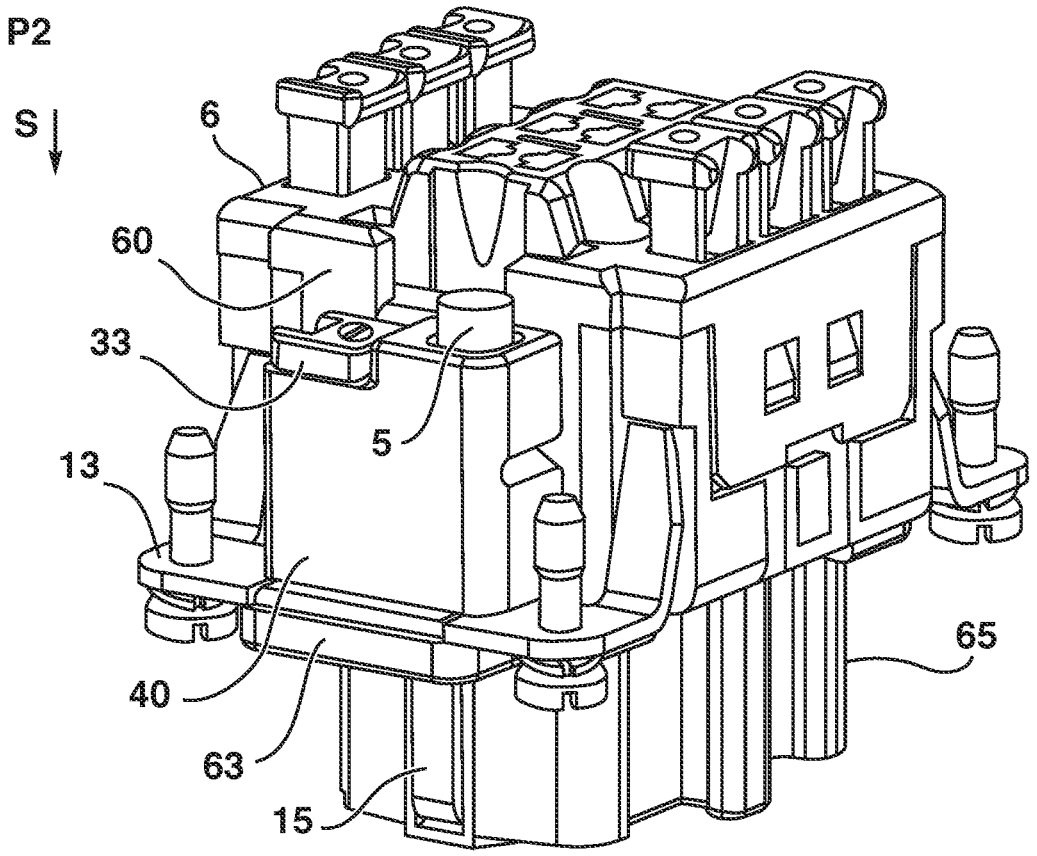
FIG. 5 shows the grounding element of FIG. 4A in the second position, which grounding element is mounted as intended on an insulating body of a plug connector and equipped with a protective conductor and a housing.

FIG. 5 shows the grounding element 1 mounted as intended on a wall 60 of the insulating body 6 of a plug connector and with the grounding element 1 equipped with the protective conductor 5 and the housing half shell 4 in the second position P2. The protective conductor 5 is inserted into the protective conductor entry 45 of the housing half shell 4, wherein the wall 40 thereof is spaced from the wall 60 of the insulating body 6 whilst the grounding element 1 extending in the mating direction S abuts in an interlocking manner against the wall 60 of the insulating body 6 by means of its mounting region 10 and its contact element 15 formed as a contact pin, which is angled at its end.

The contact element 15 is arranged on the connection region 65 of the insulating body 6 to provide an electrical contact with a mating plug connector. A flange provided by means of the third and fourth limb 13 has a contact surface equipped with two screws and rests on a protrusion 63 of the insulating body 6, which is formed on the wall 60, to provide an electrical contact with a plug connector housing (not illustrated) for mounting to the plug connector housing by means of the screws.

Even where combinations of different aspects or features of the invention are shown in the figures in each case, it is clear to a person skilled in the art—unless indicated otherwise—that the combinations shown and discussed are not the only possible combinations. In particular, mutually corresponding units or feature complexes from different exemplary embodiments can be interchanged with one another.

LIST OF REFERENCE SIGNS

1 Grounding element
10 Mounting region
11 First limb, busbar
111 Lug
12 Second limb, opposite limb
13 Third, fourth limb, contact surface, flange
14 Aperture
15 Contact element, contact pin
2 Spring element, cage clamp
20 Window aperture
21 Contact surface
211 Lug
22 Tensioning limb
3 Actuating element
30 Tensioning shoulder
31 Tensioning chamfer
32 Actuating aperture
33 Head
34 Tool insertion opening
35 Engagement chamfer

36 Engagement step
37 Tool
4 Housing half shell
40 Wall
41, 42 Projection
410, 411, 420, 421 Bearing surface
412 Aperture
413, 423 Bearing surface, guide
43 Chamfer, stop
44 Peg
45 Aperture, protective conductor entry
46 Protrusion, block, overbending protection
5 Protective conductor
6 Insulating body
60 Wall
63 Protrusion, supporting surface
65 Connection region
L Line
P1, P2 Position
S Mating direction

The invention claimed is:

1. A protective conductor connection for connecting a protective conductor (5) to a plug connector, comprising:
a grounding element (1), including
a busbar (11) which extends in a mating direction (S) of the plug connector,
a mounting region (10) for mounting the grounding element (1) on a wall (60) of an insulating body (6) of the plug connector,
a contact element (15) for providing an electrical contact with a mating plug connector, and
a contact surface (13) for providing an electrical contact with a plug connector housing;
a spring element (2) having
a planar contact surface (21) which abuts a first side of the busbar (11), and
a window aperture (20) for receiving the protective conductor (5) therethrough and pulling the protective conductor (5) towards a
second side of the busbar (11) opposite the first side; and an actuating element (3)
slidingly
arranged on the mounting region (10),
wherein the actuating element (3) and the spring element (2) are formed and arranged in such a way that the actuating element (3), upon its actuation, cooperates with the spring element (2) in such a way that
a contact connection of the protective conductor (5) to the busbar (11) is opened by the spring element (2) in a first position (P1) of the actuating element (3) in the mating direction (S), and
a contact connection of the protective conductor (5) to the busbar (11) is closed by the spring element (2) in a second position (P2) of the actuating element (3) in the mating direction (S).

2. The protective conductor connection as claimed in claim 1,
wherein the actuating element (3) is formed and arranged to be displaceable in the mating direction (S) in such a way that the actuating element (3)
can be brought from the first position (P1) into the second position (P2) by a first actuation of the actuating element (3) acting in the mating direction (S), and
can be brought from the second position (P2) into the first position (P1) by a second actuation of the actuating element (3) acting contrary to the mating direction (S).

3. The protective conductor connection as claimed in claim 1,
wherein the mounting region (10) of the grounding element (1) has an angled first limb (11) and a second limb (12) formed opposite one another,
wherein the busbar is formed by the angled first limb (11), and the spring element (2) and the actuating element (3) are adjacently arranged between the angled first limb (11) and second limb (12) in such a way that a contour of the actuating element (3) cooperates with an adjacent contour of the spring element (2).

4. The protective conductor connection as claimed in claim 3,
wherein the contact surface for providing an electrical contact with the plug connector housing is provided by a third and fourth limb (13), which are symmetrically formed on the mounting region (10), angled perpendicularly towards the mating direction (S), and are provided for mounting on a protrusion (63) formed on the wall (60) of the insulating body (6); and
wherein a stop for the actuating element (3) in the mating direction (S) of the plug connector is provided by one of the limbs (13).

5. The protective conductor connection as claimed in claim 3,
wherein the spring element (2) is a cage clamp,
wherein the spring element (2) has tensioning limb (22);
wherein the planar contact surface (21) abuts extensively against a first contact surface of the angled first limb (11), which is opposite the second limb (12);
wherein the window aperture (20) embraces a freely projecting lug (211) of the spring element (2), which is slightly angled and adjoins the contact surface (21) of the spring element (2), and moreover an upper, angled lug (111) of the angled first limb (11);
wherein, in the first position (P1), the window aperture (20) of the spring element (2) extends beyond a second contact surface of the angled first limb (11) and is exposed for receiving a protective conductor (5); and
wherein, in the second position (P2), the spring element (2) clamps a protective conductor (5) inserted into the window aperture (20) against the second contact surface of the angled first limb (11) and the upper lug (111).

6. The protective conductor connection as claimed in claim 5,
wherein the actuating element (3) is formed like a bolt;
wherein the actuating element (3) extends between the first (11) and second (12) limb in the mating direction (S) and abuts with a first side against a contact surface of the second limb (12), which is opposite the first contact surface of the angled first limb (11);
wherein a second side of the actuating element (3), which faces the spring element (2), has a tensioning shoulder (30), a tensioning chamfer (31) and an actuating aperture (32); and
wherein the first side of the actuating element (3), which abuts against the contact surface of the second limb (12), has an engagement chamfer (35) having an adjoining engagement step (36), which are accessible for a tool (37) via a tool insertion opening (34) formed in a head (33) of the actuating element (3).

7. The protective conductor connection as claimed in claim 6, wherein, in the first position (P1), the tensioning shoulder (30) of the actuating element (3) cooperates with the tensioning limb (22) of the spring element (2) in such a way that the spring element (2) is tensioned by a tensioning force provided by means of the actuating element (3) and the second limb (12) in such a way that the window aperture (20) extends beyond the second contact surface of the angled first limb (11) and is exposed for receiving a protective conductor (5);

wherein, in the second position (P2), the actuating aperture (32) of the actuating element (3) cooperates with the tensioning limb (22) of the spring element (2) in such a way that the spring element (2) clamps a protective conductor (5) inserted into the window aperture (20) against the second contact surface of the angled first limb (11) and the upper lug (111) by means of a spring force; and wherein, upon an actuation of the actuating element (3), the tensioning limb (22) of the spring element (2) cooperates with the tensioning chamfer (31) of the actuating element (3) in such a way that the actuating element (3) is brought from the first (P1) or second (P2) position into the second (P2) or first position (P1) in each case.

8. The protective conductor connection as claimed in claim 6, having a housing half shell (4) formed and cooperating in an interlocking manner with the mounting region (10), wherein the mounting region (10) and the housing half shell (4) can be assembled to form a housing and the spring element (2) and the actuating element (3) are accommodated in the housing.

9. The protective conductor connection as claimed in claim 8, wherein the housing half shell (4) has an inner contour;

wherein a first projection (41) having a protective conductor entry (45) is formed on a wall (40) of the housing half shell (4);

wherein the first projection (41) has a peg (44) formed to interlock with an aperture (14) formed in the mounting region (10);

wherein the first projection (41) has a first and second bearing surface (410) for bearing against the mounting region (10) and a third and fourth bearing surface (411) for bearing against the angled first limb (11);

wherein the first projection (41) has an aperture (412) for receiving the spring element (2) protruding beyond the second contact surface of the angled first limb (11) in the first position (P1); and the first projection (41) has a fifth bearing surface (413) for bearing against the actuating element (3); and wherein the first projection (41) has a chamfer (43) by means of which a stop for the actuating element (3) is provided contrary to the mating direction (S);

wherein a second lateral projection (42) having a first and second bearing surface (421) for bearing against the second limb (12) and having a third bearing surface (423) for bearing against the actuating element (3) and having a fourth bearing surface (420) for bearing against the mounting region (10) is formed on the wall (40);

wherein a guide for a displacement of the actuating element (3) from the first position (P1) to the second position (P2) in the mating direction (S) and from the first position (P1) to the second position (P2) contrary to the mating direction (S) is provided by means of the third bearing surface (423) of the second projection (42) and the fifth bearing surface (413) of the first projection (41); and wherein a central block (46) is formed on the wall (40), which block has a contour such that overbending protection is provided for the spring element (2).

10. The protective conductor connection as claimed in claim 9, wherein opposing walls of a housing are provided by means of a central region of the mounting region (10) of the grounding element (1) and the wall (40) of the housing half shell (4), which housing accommodates the spring element (2) and the actuating element (3) and has the head (33) of the actuating element (3) protruding from it contrary to the mating direction (S) for its actuation.

11. A plug connector, comprising:

a grounding element (1), including a mounting region (10) for connecting the grounding element (1) to an insulating body (6) of the plug connector, a first limb (11) extending perpendicular from the mounting region away from the insulating body (6) of the plug connector, and a second limb (12) extending perpendicular from the mounting region away from the insulating body (6) opposite and parallel to the first limb (11);

a cage clamp (2), including a planar contact surface (21), a tensioning limb (22), and a window aperture (20);

an actuating element 3), including a head (33), and a generally cuboid body, the generally cuboid body having a cage-clamp facing side which includes a recessed actuating aperture (32) and a tensioning shoulder (30) that are separated by a tensioning chamfer (31); and a housing half shell (4) including a wall (40), a central block (46) extending inwardly from the wall (40), wherein the planar contact surface (21) of the cage clamp (2) abuts the first limb (11), wherein an upper lug (111) extending from the first limb (11) extends through the window aperture (20) of the cage clamp (2), wherein the actuating element (3) is movably arranged between the second limb (12) and the cage clamp (2), wherein, when the actuating element (3) is in a first position (P1), the tensioning limb (22) of the cage clamp (2) abuts the tensioning shoulder (30) of the actuating element (3) and is thereby pushed into an open position in which the window aperture (20) can receive or release a protective conductor (5), wherein, when the actuating element (3) is in a second position (P2), the tensioning limb (22) of the cage clamp (2) extends into the recessed actuating aperture (32) of the actuating element (3) and is thereby relaxed into a closed position in which the window aperture (20) pulls the protective conductor (5) towards the first limb (11).

* * * * *